US011437005B1

(12) United States Patent
Smith

(10) Patent No.: US 11,437,005 B1
(45) Date of Patent: Sep. 6, 2022

(54) MULTI-STRINGED MUSICAL INSTRUMENT TUNABLE BY MEANS OF LINEAR ACTUATORS

(71) Applicant: Paul Smith, Nashville, TN (US)

(72) Inventor: Paul Smith, Nashville, TN (US)

(73) Assignee: Paul Smith, Nashville, TN (US)

( * ) Notice: Subject to any disclaimer, the term of this patent is extended or adjusted under 35 U.S.C. 154(b) by 0 days.

(21) Appl. No.: 17/719,559

(22) Filed: Apr. 13, 2022

(51) Int. Cl.
*G10H 1/44* (2006.01)
*G10D 1/08* (2006.01)
*G10D 3/06* (2020.01)

(52) U.S. Cl.
CPC ..... *G10H 1/44* (2013.01); *G10D 1/085* (2013.01); *G10D 3/06* (2013.01)

(58) Field of Classification Search
CPC ..... G10H 1/44; G10D 1/085; G10D 3/06
See application file for complete search history.

(56) References Cited

U.S. PATENT DOCUMENTS 3,894,468 A * 7/1975 Dunlap ..... G10D 3/06 984/115
4,722,260 A * 2/1988 Pigozzi ..... G10D 1/085 984/115
5,325,757 A * 7/1994 Ghenea ..... G10D 1/08 84/314 R
2004/0194606 A1* 10/2004 Koeppe, Jr. ..... G10D 3/06 84/293

OTHER PUBLICATIONS

Microtonal Guitar (Adjustable)—Tolgahan Çoğulu—Part 1—Makam Music https://www.youtube.com/watch?v=MYK_PF9WTRE 2010 viewed online on Jun. 16, 2022 (Year: 2010).*

* cited by examiner

*Primary Examiner* — Jianchun Qin
(74) *Attorney, Agent, or Firm* — Adam W. Bell

(57) ABSTRACT

A multi-stringed musical instrument, such as a guitar, having a neck with a partially hollow interior containing a number of linear actuators, each connected to a fret which projects proud of the neck and is in contact with a taught string, wherein the linear actuators are controlled by means of a user-selected input signal via functional communication with a small control panel, tablet, smartphone, computer or laptop.

16 Claims, 6 Drawing Sheets

Chords of key Eb major

Eb
C minor
Ab
F minor
Bb
D diminished
G minor
Eb major 7
C minor 7
Ab major 7
F minor 7
Bb7
D half diminished
G minor 7

Chords used most often ← Chords used less often →

MULTI-STRINGED MUSICAL INSTRUMENT TUNABLE BY MEANS OF LINEAR ACTUATORS

BACKGROUND

For someone who has arthritis, carpel tunnel syndrome, or hand injury, playing guitar can be very difficult and painful. If someone has a broken or missing hand, they cannot play guitar. Each string of a standard guitar has a possible 20-24 notes that can be played. But humans only have 10 fingers and 2 hands, and only one hand can be used for fretting notes. Chords are limited to the range of a human hand. There is a need for an alternative string fretting device.

BRIEF DESCRIPTION OF THE INVENTION

This guitar comprises 6 linear actuators that tune 6 strings. The actuators are controlled wirelessly with a control panel and a tablet computer.

DETAILED DESCRIPTION OF THE INVENTION

Figure 1:
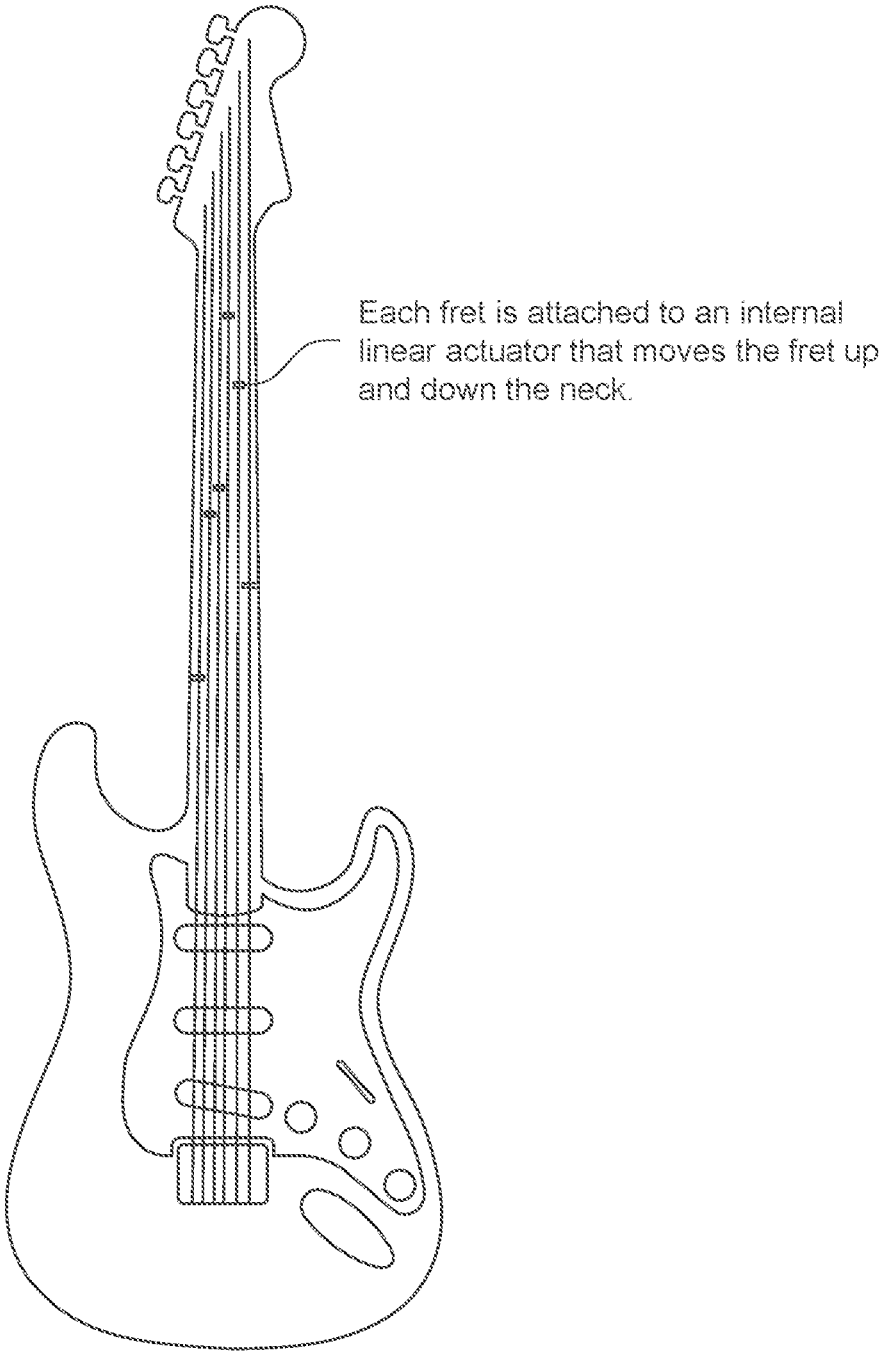
FIG. 1. Guitar with 6 separate frets attached to 6 corresponding linear actuators.

With this guitar, difficult chords and chord progressions can be played easily. Custom chords can be programmed that would be impossible on a regular guitar. No alternate tunings are needed, no capos. Barre chords are easy to play. All barre chords can use 6 strings. This instrument can be played a very long time without hand discomfort. It will assist song writers. Writers can put new chords into their songs that they are not accustomed to playing. This guitar can be made more cheaply than a pedal steel guitar, and it can create similar sounds. This device comprises an evolution of a standard 6 string electric guitar (FIG. 1).

Six linear actuators reside within the guitar neck. There are six longitudinal slots that extend the length of the neck, with no fret bars on the neck. An electrical motor or pulley system or other mechanism resides within the neck and/or slot. This motor mechanism acts as and can be defined as a means to move a fret, and may be called a "fret positioning means". An "actuator" refers to the mechanism that moves the fret. A fret is physically attached to the motor or pulley mechanism. The actuator may comprise a sliding block or shaped piece that resides either under the slot or projects above the slot. Attached to this actuator piece is a fret that may be comprised of a pointed shape with a small notch in the middle to keep the strings centered. The frets float just above the neck, underneath the strings.

Figure 2:
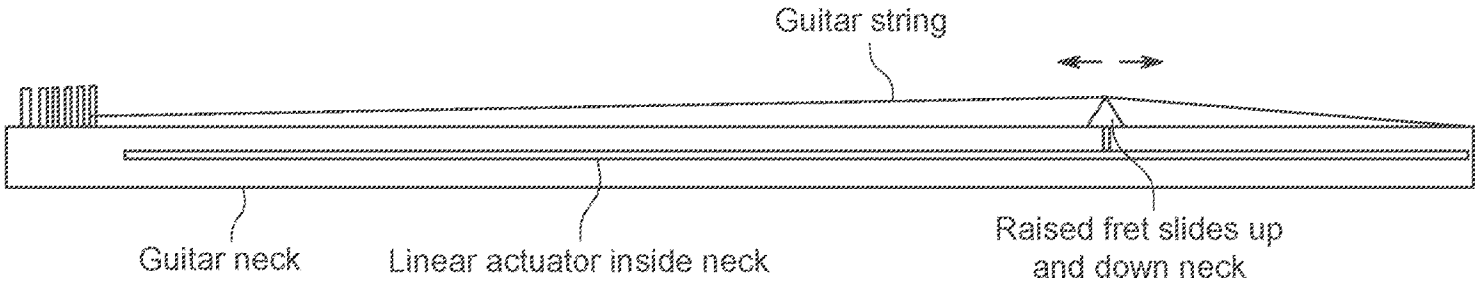
FIG. 2. Side view cutaway of guitar neck showing linear actuator attached to fret and fret pressing guitar string up and away from the neck.

A sliding fret is attached to each actuator through each longitudinal slot (FIG. 2). It slides up and down the neck, under the string. The frets are comprised of a pointed shape with a small notch in the middle to keep the strings centered.

The frets float just above the neck, underneath the strings. They raise the string out and away from the neck. The string exerts force down on the actuator. The actuator must not negate or cancel the vibration of the string.

The actuators may be moved to any one of about 20 or 24 programmable fret positions. The default or "off" position requires the actuator to be at or near the nut position at the top of the neck. The strings are visible and accessible, they are not covered. The strings can be manipulated by the guitar player by pressing down on the strings and bending pitches while playing. A safety cover can be attached for children or beginners to protect young hands from fast moving actuators. The linear actuators can be moved at a fast speed and one or more slow speeds that can be selected. These speeds will create slide guitar effects. The actuators are controlled with a small control panel (FIG. 3) and a tablet, smartphone or pc laptop.

Figure 3:
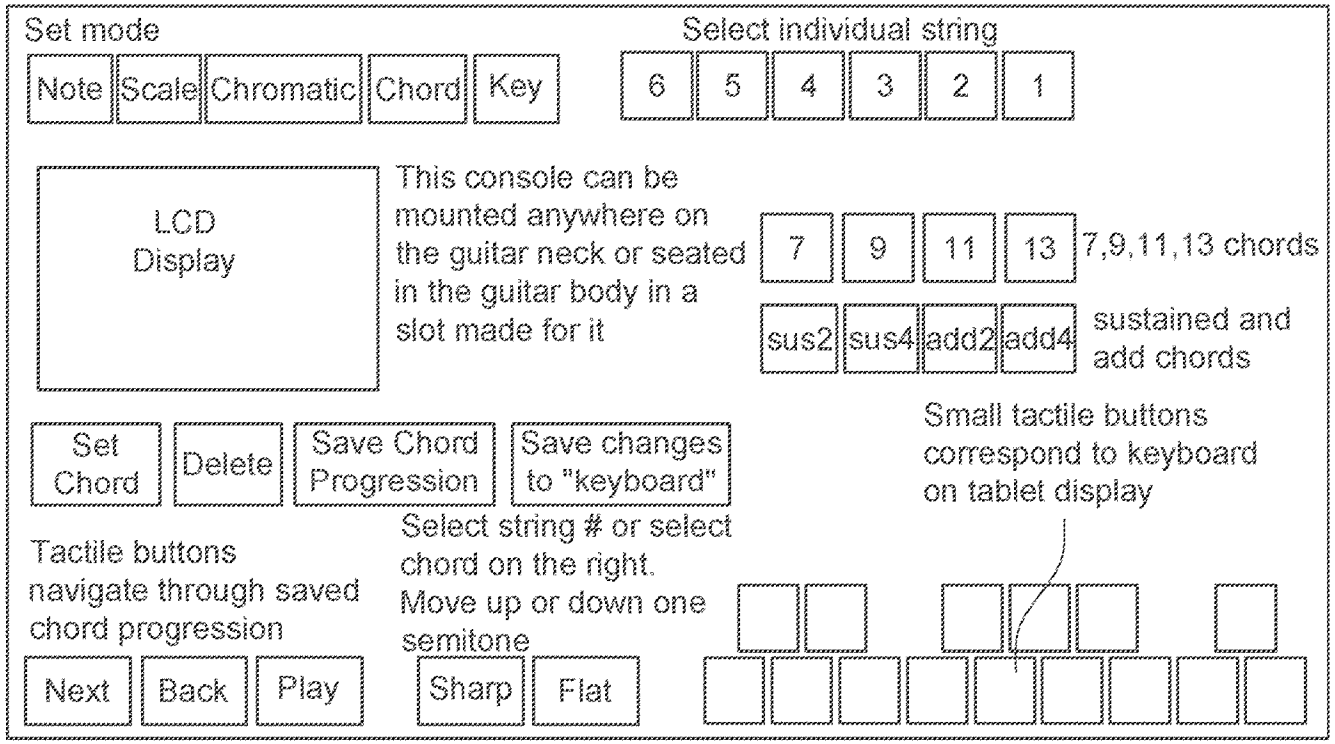
FIG. 3. Example layout and description of wireless control panel.
Figure 4:
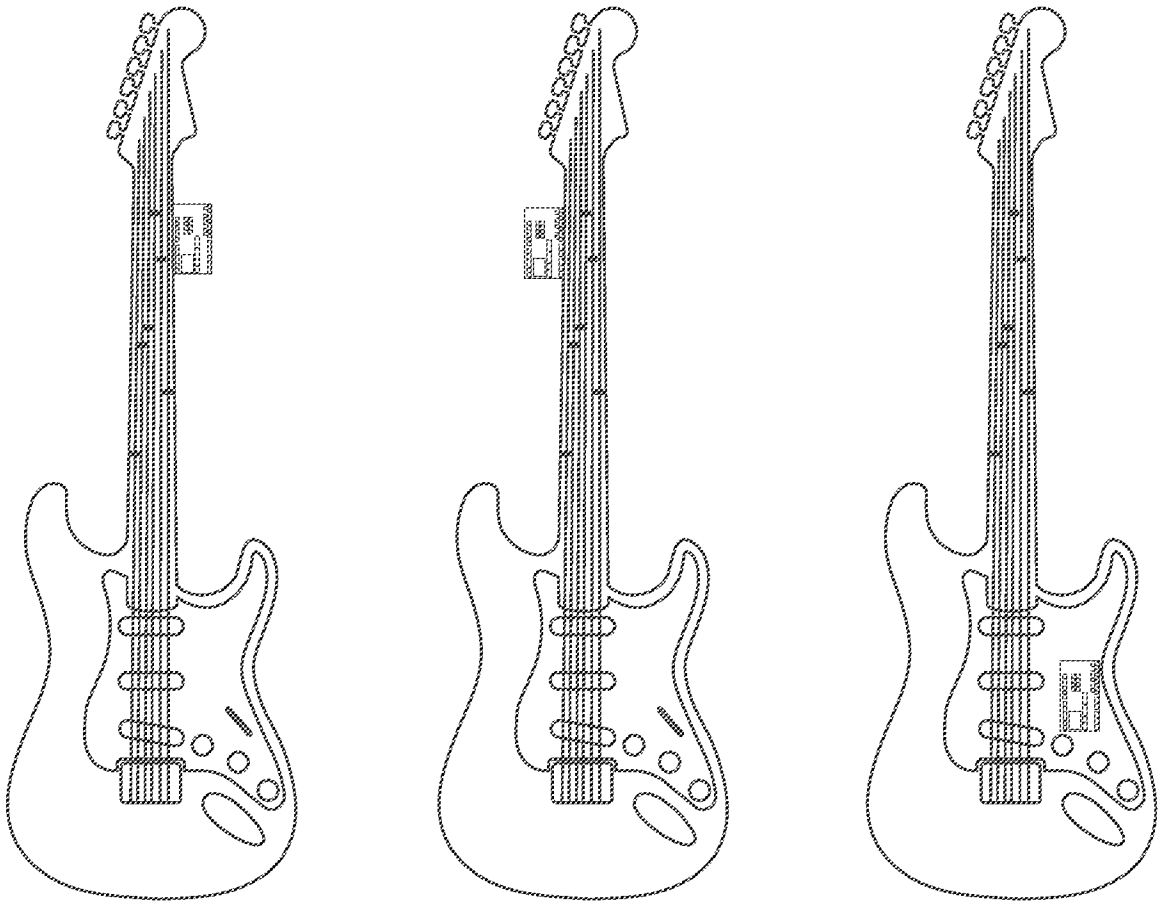
FIG. 4. Control panel mounted to guitar in various places.
Figure 5:
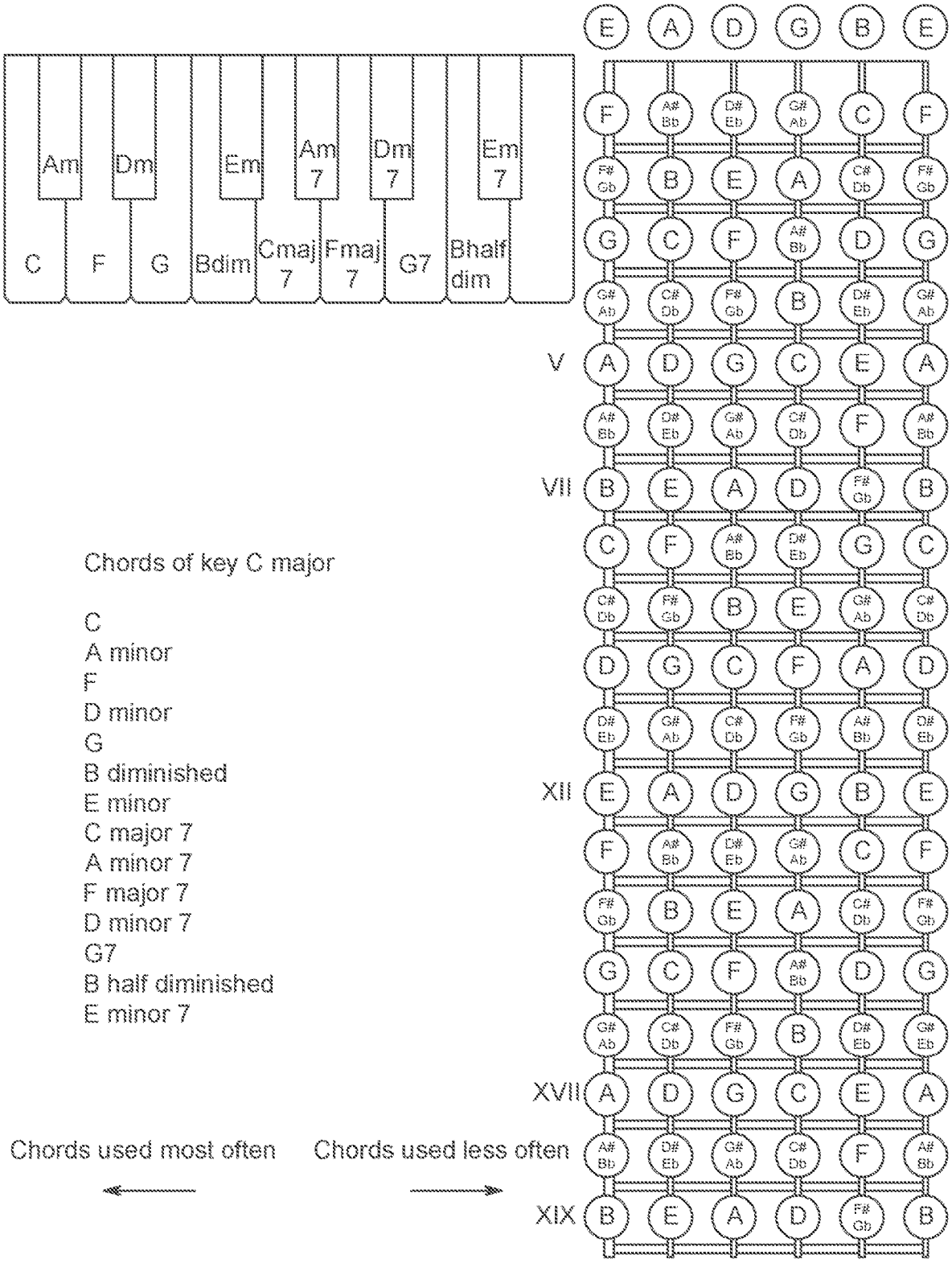
FIG. 5, 6, 7. Example tablet display showing keyboard notes or programmed chords. The current tuning of each string is displayed.
Figure 6:
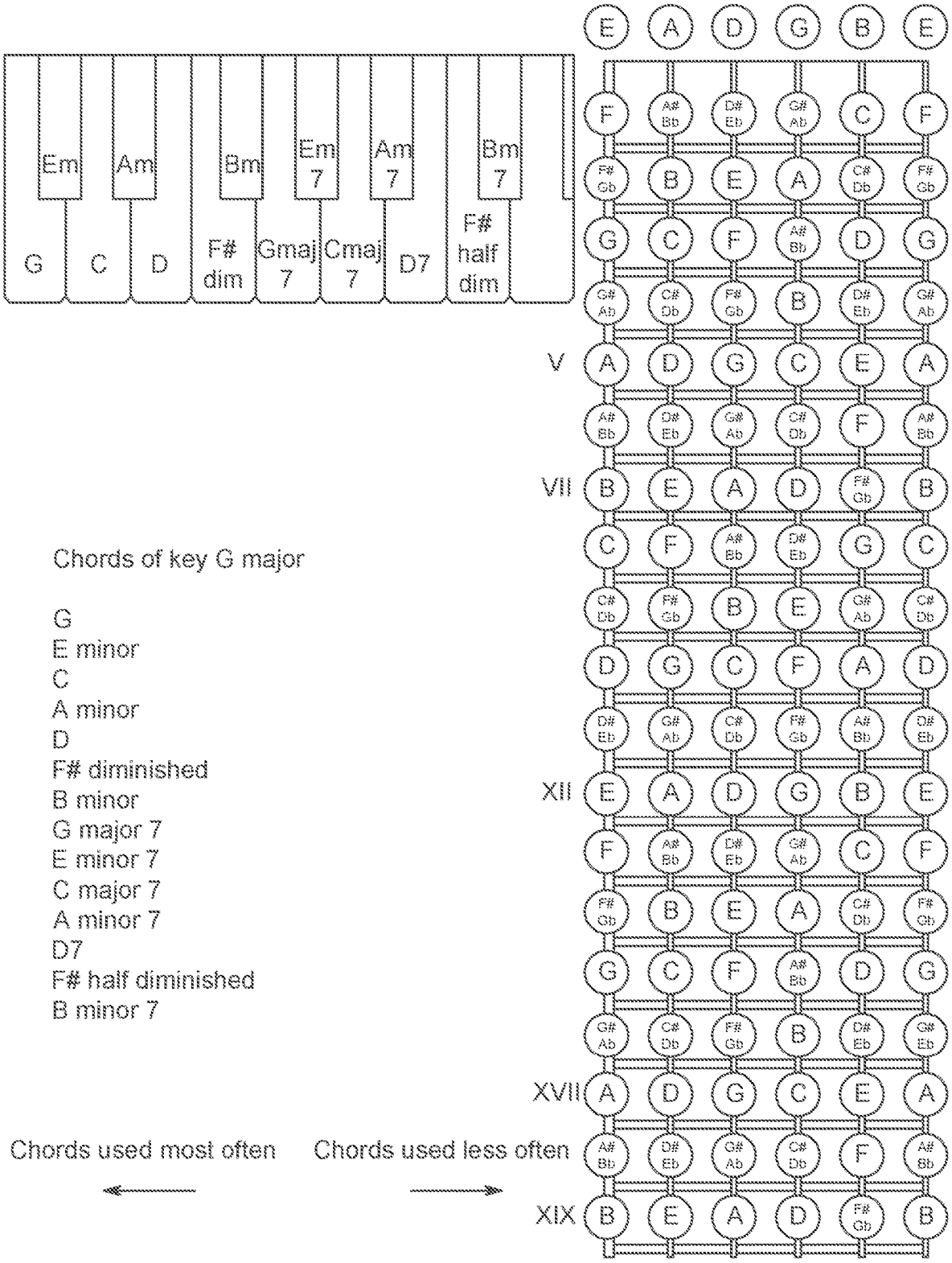
Figure 7:
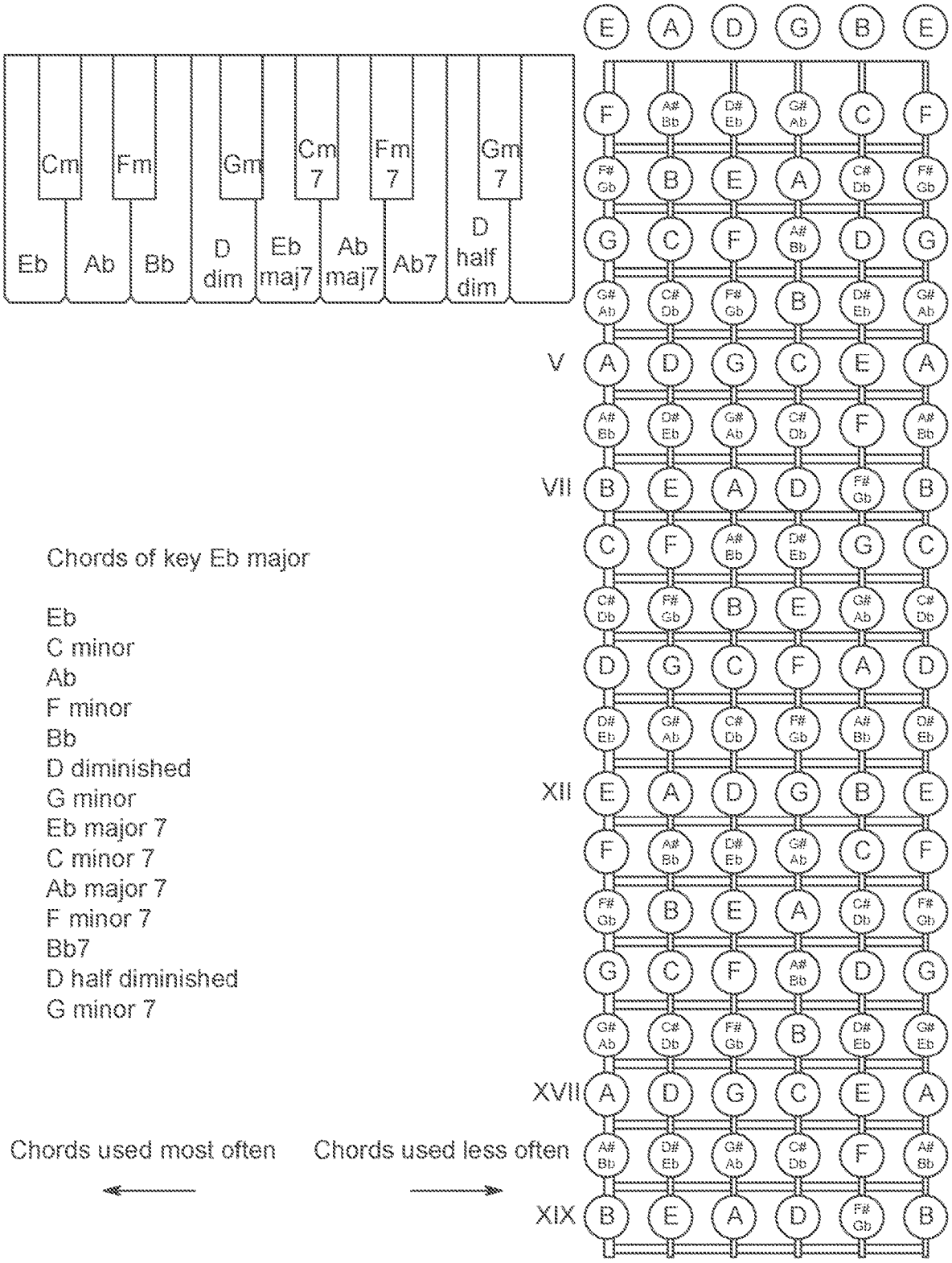

The control panel may comprise a dedicated console with tactile buttons (FIG. 3). The buttons may a select key signature, diatonic scale, chromatic scale, chords, or singular notes. The console may be comprised of a small music "keyboard" with 12 to 15 keys. The console is comprised of LED lights adjacent to or lighting the buttons and an LCD display. The console is connected to the linear actuators inside the guitar via Bluetooth, Wi-Fi, or some other wireless technology. It can be mounted to different places on the guitar body or neck, depending on the user's preference (FIG. 4). It can be mounted right side up or upside down. It can be operated by the strumming hand or the fretting hand. The console is connected by wireless technology to a tablet, smartphone, or pc laptop, which can be placed on a table or music stand. The tablet, smartphone, or pc laptop display comprises very detailed information the console is not able to display (FIG. 5, 6, 7). A piano keyboard and 6 strings are displayed, the current note on each string highlighted. Whenever a button is pressed on the console, the frets on each string move to their proper position.

There is a pre-programmed set of chords for each "key" used in music (C major, G major, E flat major, F major, etc., See FIG. 5, 6, 7. The chords are ordered left to right based on frequency in music. The white keys are major chords. The black keys are the relative minor chords. (FIG. 3) The small keyboard is played with each key assigned to a specific chord. (FIG. 3) Chord progressions are programmed and saved, then "played" back with a "next" button advancing through the chords as the song is played. Scales and chromatic scales are played across adjacent strings by using the "next" button to shift the scale. For example, with the chromatic scale you can play the first 3 notes, 1-2-3 on the first 3 strings, press "next", play 4-5-6-7-8-9, press "next", play 10-11-12 on the last 3 strings. Diatonic scales can be played in a similar way. One note can be played in 3 octaves across 6 strings. For example, C1-C1-C2-C2-C3-C3. Individual strings can be selected and shifted up or down one semitone by pressing flat or sharp. Some functions on the console can additionally be controlled by wireless foot pedals.

EXEMPLARY EMBODIMENTS OF THE INVENTION

The invention, in its most general embodiment is a multi-stringed (2 or more strings) musical instrument comprising a body and a neck (the neck may be long or short of vestigial) attached to said body and projecting therefrom, wherein the neck has a front face and a back face, wherein the instrument comprises a plurality of linear actuators selected from the group consisting of: a belt system, a pneumatic system, a rod system, a linear motor system, and linear stepper motor system, wherein the linear actuators are controlled by means of a user-selected input signal which may be delivered by wire or wirelessly, wherein each linear actuator is connected to a fret which projects proud of the front face of the neck through one of six slots and is adapted to make contact with one of said strings when in use, wherein the instrument further comprises a plurality (2 or more) of strings that are held taught, positioned slightly above the front face of the neck, parallel (approximately parallel) to and above the slots, wherein each end of each of said plurality of strings is attached securely to either the instrument neck or the instrument body, and each of said strings is in contact with one of said frets.

The linear actuators will be in functional communication with an energy source such as a battery or mains source, and with one or more input signals that control them.

To phrase the device in a slightly different way, which may be necessary for supporting various versions of the claims, it can be defined as a multi-stringed musical instrument comprising a body and a neck attached to said body and projecting therefrom, wherein the neck comprises a plurality of neck walls (two or more walls), having a front face and a back face, and a partially hollow interior (i.e. defining a partial void within the neck), and wherein the neck of the instrument comprises a plurality of linear actuators firmly attached to one or more of the neck walls, and wherein each of said linear actuators is connected to a fret which projects proud of the front face of the neck and is adapted to make contact with one of said strings when in use.

The invention may be embodied in various additional ways, for example, as follows.

In one embodiment the invention encompasses a six-string guitar comprising a body and a neck attached to said body and projecting therefrom, wherein the neck has a front face and a back face, wherein six strings are held taught, positioned along and slightly above the front face of the neck, attached securely at each end of the string, wherein the guitar further comprises six linear actuators, each actuator connected to a fret, wherein each fret is projected through one of six longitudinal slots, wherein the slots extend along the front face of the neck, substantially parallel to and beneath the strings. Each of said frets is slidably moveable up and down the neck, under one of said strings. Each of said frets project proud of the front face of the neck, adapted to make contact with one of said strings when in use.

In this embodiment, each fret may be activated (slidably moved) individually or two or more frets can be activated at the same time, either together in the same direction or in different directions such that the frets come to rest at predetermined and programmable locations.

In some embodiments each of said frets comprises an approximately pointed shape with a small notch in the middle to keep the strings centered. The shape could equally be rounded, flat or any other shape fit for purpose. Frets may be made of metal, a polymer, or an organic material such as wood, but metal is preferred. Each fret projects proud of the front face of the neck Each of the frets may be programmably positioned at up to 24 programmable positions. The linear actuators attached to the frets may consist of a belt system, pneumatic system, rod system, linear motor system, or linear stepper motor system. Each fret may be moved at one or more predetermined speeds. Such speeds may be descriptively called fast, medium and slow.

In one embodiment each of the strings can be manipulated by a guitar player by pressing down, usually with the finger, upon the strings and bending pitches while playing.

In a further embodiment the actuator speeds may be subjectively called fast, medium or slow, and wherein use of slow speeds creates slide guitar effects. Each of said linear actuators may be controlled via functional communication (wired or wireless) with a small control panel, tablet, smartphone, computer or laptop. The control panel may comprise a dedicated console with tactile buttons. And the console may be functionally connected to the linear actuators inside the guitar via Bluetooth, Wi-Fi, or another wireless technology. The buttons may comprise a small music keyboard with any number of keys, for example from 6 to 10 to 15 to 20 to 26, or in preferred embodiments, 12 to 15 keys. The console can be mounted to different places on the guitar body or neck, depending on the user's preference.

In a further embodiment the guitar further comprising one or more sensors that track hand or body movements, wherein said hand movements control the motion and positioning of said actuators.

In one embodiment the guitar includes a button (a "next" button) that can be used to play diatonic and chromatic scales across adjacent strings. A chord progression can be saved and played back using a "next" button so that the actuators move to recreate the chord progression. In one embodiment of the guitar a button is adapted to instruct the actuators such that they can be used to play diatonic and chromatic scales across adjacent strings.

The console may be connected by wireless technology to a tablet, smartphone, or pc laptop.

The tablet, smartphone, or pc laptop display comprises a piano keyboard, 6 strings with notes, chord lists and chord progression information. The tablet, smartphone, or pc laptop display comprises chord assignments for the keyboard, current note tuned on string.

The guitar of the invention requires a computer to control the actuators. The computer may be in the control panel or in the smartphone/tablet/laptop. All multiple position actuators comprise basic computers and/or switches that tell them when to start and when to stop, to arrive at a certain position. In the preferred embodiment of the guitar, these computers and/or switches would be controlled wirelessly by a separate computer.

The neck of the guitar has six longitudinal slots within the neck. A linear actuator resides under each slot. Attached to this linear actuator is a "fret" that is comprised of a pointed shape with a small notch in the middle to keep the string centered. The fret floats just above the neck face, underneath the strings. It slides up and down the neck, under the string.

The linear actuators reside within the neck. These linear actuators can be selected from the group consisting of: a belt system, a pneumatic system, a rod system, a linear motor system, and linear stepper motor system. The linear actuators must not cancel or negate the vibration of the instrument strings.

Note that the linear actuator is not visible in FIG. 1. The slots are also not visible. The slots are directly beneath the strings. What is visible is the frets attached to the linear actuator inside the neck. FIG. 2 shows a side view cutaway of the guitar, the slot on top is not visible.

Each fret can be moved to 20 or 24 programmable positions. But in other embodiments, the frets can be moved to any position whatsoever along the length of the neck. The frets can be moved by stepping, or continuously and smoothly along the slot.

In one embodiment the fret is in constant contact with the string, and pushes against the string from underneath and holds the string taught at any pre-determined position to create the desired note.

Although the invention may employ various means for linear positioning, for the sake of completeness we will discuss one or two here. A linear synchronous motor is often used in scanning and printing machines. Linear motors are very robust and efficient. Belts and rack and pinions are well-established drive mechanisms in linear actuators, providing high-speed travel over long lengths. And both are frequently used in large systems, though they are ideal for the present application. Rack and pinion systems used in linear actuators consist of a rack (also referred to as the "linear gear"), a pinion (or "circular gear"), and a gearbox. The gearbox helps to optimize the speed of the servo motor and the inertia match of the system. The teeth of a rack and pinion drive can be straight or helical, although helical teeth are often used due to their higher load capacity and quieter operation. For rack and pinion systems, the maximum force that can be transmitted is largely determined by the tooth pitch and the size of the pinion. Rack and pinions, on the other hand, can be constructed in nearly unlimited lengths. Rack sections can be joined endlessly, although the guide mechanism (profiled rail or cam roller, for example) can be the limiting factor in maximum stroke length. Rack and pinion systems can operate in one of two ways: with the pinion (including gearbox and motor) moving and the rack stationary, or with the pinion assembly stationary and the rack moving. The first scenario is more common, although it does introduce more complex cable management. The benefit of a moving pinion assembly is that the moving mass and inertia are lower than if the entire rack were the moving component. This keeps the required motor smaller and eliminates the need for extremely high gear ratios.

Positioning accuracy is important in the guitar invention. While rack and pinion systems have not historically been thought of as "precise" when compared to ball screws and linear motors (although that perception is changing), they do hold an advantage over belt drives in terms of positioning accuracy. This is because no matter how precise the belt profile and pulley teeth are, it's an unavoidable fact that belts have compliance and are plastic. This means that they will eventually stretch, especially if their tensile strength is exceeded. Rack and pinion systems do have backlash, due to the meshing of gear teeth. But high precision helical rack and pinion systems have tooth pitch errors in the single-micron range. It's also possible to preload a rack and pinion system to prevent backlash. This is done with either a split-pinion or a dual-pinion design. In the split-pinion design, two pinion halves mesh with opposite tooth flanks on the same rack. One pinion half is driven and the other half is preloaded with an axial spring pack in order to remove backlash. The dual-pinion design uses a driven (aka "master") pinion and a preloaded (aka "slave") pinion, each driven by a gearbox and motor. Preload is managed electronically through the controller.

Timing belts for linear actuators are typically made of polyurethane reinforced with internal steel or Kevlar cords. The most common tooth geometry for belts in linear actuators is the AT profile, which has a large tooth width that provides high resistance against shear forces. On the driven end of the actuator (where the motor is attached) a precision-machined toothed pulley engages with the belt, while on the non-driven end, a flat pulley simply provides guidance. The non-driven, or idler, pulley is often used for tensioning the belt, although some designs provide tensioning mechanisms on the carriage. The type of belt, tooth profile, and applied tension force all determine the force that can be transmitted.

The guitar of the invention may also employ belt drive systems which are able to achieve high speeds, since belt drive mechanisms do not use recirculating elements. When paired with non-recirculating guides, such as cam rollers or wheels, belts can typically achieve speeds up to 10 m/s. Belt driven systems are also well suited for harsh environments, since there are no rolling elements to be damaged by debris, and the polyurethane belt material can withstand most common types of chemical contamination. The primary drawback of belt driven systems is that belts stretch. Even steel-reinforced belts, which are used by most system manufacturers, will eventually experience some stretch, which degrades repeatability and travel accuracy. Belt driven systems also have more resonance than other types of drives, due to the elasticity of the belt. While proper drive tuning can compensate for this, applications with high acceleration and deceleration rates and/or heavy loads may experience undesirable settling times.

General disclosures: All references and publications disclosed herein are hereby incorporated by reference for all purposes. In this specification, reference is made to particular features of the invention. It is to be understood that the disclosure of the invention in this specification includes all appropriate combinations of such particular features. For example, where a particular feature is disclosed in the context of a particular embodiment or a particular claim, that feature can also be used, to the extent appropriate, in the context of other particular embodiments and claims, and in the invention generally. The embodiments disclosed in this specification are exemplary and do not limit the invention. Other embodiments can be utilized and changes can be made. As used in this specification, the singular forms "a", "an", and "the" include plural reference unless the context clearly dictates otherwise. Thus, for example, a reference to "a part" includes a plurality of such parts, and so forth. The term "comprises" and grammatical equivalents thereof are used in this specification to mean that, in addition to the features specifically identified, other features are optionally present. The term "consisting essentially of" and grammatical equivalents thereof is used herein to mean that, in addition to the features specifically identified, other features may be present which do not materially alter the claimed invention. The term "at least" followed by a number is used herein to denote the start of a range beginning with that number (which may be a range having an upper limit or no upper limit, depending on the variable being defined). For example, "at least 1" means 1 or more than 1, and "at least 80%" means 80% or more than 80%. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)-(a second number)", this means a range whose lower limit is the first number and whose upper limit is the second number. Where reference is made in this specification to a method comprising two or more defined steps, the defined steps can be carried out in any order or simultaneously, and the method can optionally include one or more other steps which are carried out before any of the defined steps, between two of the defined steps, or after all the defined steps. Where reference is made herein to "first" and "second" features, this is generally done for identification purposes; unless the context requires otherwise, the first and second features can be the same or different, and reference to a first feature does not mean that a second feature is necessarily present (though it may be present). Where reference is made herein to "a" or "an" feature, this includes the possibility that there are two or more such features (except where the context excludes that possibility).

The invention claimed is:

1. A multi-stringed musical instrument comprising a body and a neck attached to said body and projecting therefrom, wherein the neck comprises a plurality of neck walls, comprising a front face and a back face, and a partially hollow interior, wherein the guitar neck comprises a plurality of linear actuators firmly attached to one or more of the neck walls, and wherein each of said linear actuators is connected to a fret which projects proud of the front face of the neck and is adapted to make contact with one of said strings when in use, and wherein said fret is connected to a part of the linear actuator that provides accurate linear motion, and wherein said fret creates tension on the string to produce a specific note when played, and wherein the neck of the instrument has set therein a plurality of longitudinal slots that extend along the front face of the neck, wherein said fret projects through one of said slots, wherein the instrument further comprises a plurality of strings that are held taught, positioned slightly above the front face of the neck, parallel to and above the slots, wherein each end of each of said plurality of strings is attached securely to either the instrument neck or the instrument body, and each of said strings is in contact with one of said frets, wherein the linear actuators are controlled by means of a user-selected input signal, and further wherein each of said linear actuators is controlled via functional communication with a small control panel, tablet, smartphone, computer or laptop.

2. The multi-stringed musical instrument of claim 1 wherein said control panel comprises a dedicated console with tactile buttons.

3. The multi-stringed musical instrument of claim 2 wherein the buttons comprise a small music keyboard with 12 to 15 keys.

4. The multi-stringed musical instrument of claim 2 wherein a button is adapted to instruct the actuators such that they can be used to play diatonic and chromatic scales across adjacent strings.

5. The multi-stringed musical instrument of claim 2 wherein a sequence of notes or chords is can be saved and played back.

6. The multi-stringed musical instrument of claim 2 wherein said console can be optionally mounted at different locations on the guitar body or neck.

7. The multi-stringed musical instrument of claim 2 wherein said console is connected by wireless technology to a tablet, smartphone, computer or laptop and wherein said tablet, smartphone, computer or laptop comprises a display adapted to display one or more of a piano keyboard, 6 strings with notes, chord lists and chord progression information.

8. The multi-stringed musical instrument of claim 1 wherein the console is functionally connected to the linear actuators inside the guitar via Bluetooth, Wi-Fi, or another wireless technology.

9. The multi-stringed musical instrument of claim 1 wherein each fret is moved individually to a predetermined position.

10. The multi-stringed musical instrument of claim 1 wherein each of said frets comprises an approximately pointed shape with a small notch in the middle to keep the strings centered.

11. The multi-stringed musical instrument of claim 1 wherein each fret projects proud of the front face of the neck, adapted to make contact with one of said strings when in use.

12. The multi-stringed musical instrument of claim 2 wherein each of the frets is programmably positioned at up to 24 programmable positions.

13. The multi-stringed musical instrument of claim 2 wherein each of the frets is programmably positioned at any position along the neck.

14. The multi-stringed musical instrument of claim 2 wherein each of the strings is manipulated by a guitar player by pressing down on the strings and bending pitches while playing.

15. The multi-stringed musical instrument of claim 2 wherein each of said frets is moved at one or more predetermined speeds.

16. A multi-stringed musical instrument comprising a body and a neck attached to said body and projecting therefrom, wherein the neck comprises a plurality of neck walls, comprising a front face and a back face, and a partially hollow interior, wherein the guitar neck comprises a plurality of linear actuators firmly attached to one or more of the neck walls, and wherein each of said linear actuators is connected to a fret which projects proud of the front face of the neck and is adapted to make contact with one of said strings when in use, and wherein said fret is connected to a part of the linear actuator that provides accurate linear motion, and wherein said fret creates tension on the string to produce a specific note when played, and wherein the neck of the instrument has set therein a plurality of longitudinal slots that extend along the front face of the neck, wherein said fret projects through one of said slots, wherein the instrument further comprises a plurality of strings that are held taught, positioned slightly above the front face of the neck, parallel to and above the slots, wherein each end of each of said plurality of strings is attached securely to either the instrument neck or the instrument body, and each of said strings is in contact with one of said frets, wherein the linear actuators are controlled by means of a user-selected input signal, and wherein each of said linear actuators is controlled via functional communication with a small control panel, tablet, smartphone, computer or laptop, and further comprising one or more sensors that track hand or body movements, wherein said hand movements control the motion and positioning of said actuators.

* * * * *